US005679275A

United States Patent [19]

Spraggins et al.

[11] Patent Number: 5,679,275

[45] Date of Patent: Oct. 21, 1997

[54] CIRCUIT AND METHOD OF MODIFYING CHARACTERISTICS OF A UTILIZATION CIRCUIT

[75] Inventors: Gary L. Spraggins; Robert L. Vyne, both of Tempe; David M. Susak, Phoenix, all of Ariz.

[73] Assignee: Motorola, Inc., Schaumburg, Ill.

[21] Appl. No.: 497,760

[22] Filed: Jul. 3, 1995

[51] Int. Cl.[6] ..... H05B 1/02

[52] U.S. Cl. ..... 219/505; 219/494; 437/247; 437/171

[58] Field of Search ..... 219/505, 504, 219/494, 121.68, 121.69; 437/228, 171, 170, 172, 918, 919, 174, 248, 247

[56] References Cited

U.S. PATENT DOCUMENTS 4,606,781 8/1986 Vyne .
4,725,791 2/1988 Susak et al. .
4,810,663 3/1989 Raffel et al. ..... 437/19
4,962,294 10/1990 Beckham et al. ..... 219/121.68
4,991,424 2/1991 Lehto ..... 73/31.06
5,110,758 5/1992 Baskett ..... 437/171
5,466,484 11/1995 Spraggins et al. ..... 437/228

*Primary Examiner*—Mark H. Paschall
*Attorney, Agent, or Firm*—Robert D. Atkins

[57] ABSTRACT

A modification circuit (30) is thermally coupled to and electrically isolated from a circuit element (20) of a utilization circuit (10). During modification, current pulses are passed through an isolation circuit (40) to the modification circuit which heats the circuit element, e.g., a resistor, of the utilization circuit substantially above the normal operating temperature range of the element, thereby modifying the electrical characteristics of the resistor and therefore those of the utilization circuit to which it is connected. During normal operation of the utilization circuit the circuit element of the utilization circuit is electrically isolated from the modification circuit.

18 Claims, 2 Drawing Sheets

-PRIOR ART-

CIRCUIT AND METHOD OF MODIFYING CHARACTERISTICS OF A UTILIZATION CIRCUIT

BACKGROUND OF THE INVENTION

The present invention relates in general to integrated circuits and, more particularly, to a circuit and method for modifying characteristics of a utilization circuit with a modification circuit that is thermally coupled to, and electrically isolated from, an element of the utilization circuit.

It is common for integrated circuits to require certain modifications or tailoring of their characteristics in order to provide a desired or more accurate operation. As an example, the input offset voltage of an operational amplifier or the quiescent output voltage of a pressure sensor is adjusted to a precise value. The fine adjustment of integrated circuit parameters such as resistance, capacitance, or inductance in order to accomplish these modifications is commonly referred to as "trimming" and will be used as such herein. The trimming of a resistance element is the most common method of adjustment and in the past has included such methods as using an external variable resistor or potentiometer connected to the integrated circuit, as well as mechanically trimming a resistor on the integrated circuit utilizing sand blasting or laser shaping. These, as well as other methods, and their disadvantages are described in U.S. Pat. No. 4,725,791 issued to David M. Susak, et al on Feb. 16, 1988.

The U.S. Pat. No. 4,725,791 patent further describes an improved process wherein a specially constructed resistor is trimmed by pulsing the resistor with high amplitude, low duty cycle current pulses, see U.S. Pat. No. 4,606,781 issued to Robert Vyne. In this manner the resistance value is permanently altered to a new value in small increments until the desired resistance value, or other associated circuit parameter, is reached. Once the desired resistance value is reached, the trim resistor that receives the current pulses becomes a part of the utilization circuit during normal operation.

Since the trim resistor of the U.S. Pat. No. 4,725,791 patent must pass relatively high currents, there is a limitation on the value of the resistor. The trimmed resistor is also connected to the supply voltage of the integrated circuit which means that the trimmed resistor is not electrically isolated from external circuits and could be subject to damage from external electrical events such as an electrostatic discharge.

There has been described a structure and method for setting resistance values in U.S. Pat. No. 5,466,484 issued to Gary L. Spraggins on Nov. 14, 1995 and assigned to Motorola, Inc. herein referred to as the thermal trim resistor. In general, the described structure includes a heat emitting resistor that is placed above or below and dielectrically isolated from the resistor which is to be trimmed. The value of the trim resistor is modified by applying current pulses of sufficient amplitude and duration to the heat emitting resistor to increase its temperature and thereby heat the trim resistor to a temperature above which its crystal structure, and therefore its resistance is permanently changed. Although the heat emitting resistor and trim resistor are thermally coupled, there is no electrical connection and the two are therefore electrically isolated.

The thermal trim resistor structure therefore allows the trim resistor value to be selected independent of the heat emitting current pulse requirements, as well as providing for trim resistor electrical isolation and the resultant immunity from certain external electrical events such as electrostatic discharge.

It would therefore be desirable to provide the features of the thermal trim resistor in a circuit and method for integrated circuit applications.

DETAILED DESCRIPTION OF THE PREFERRED EMBODIMENT

Figure 1:
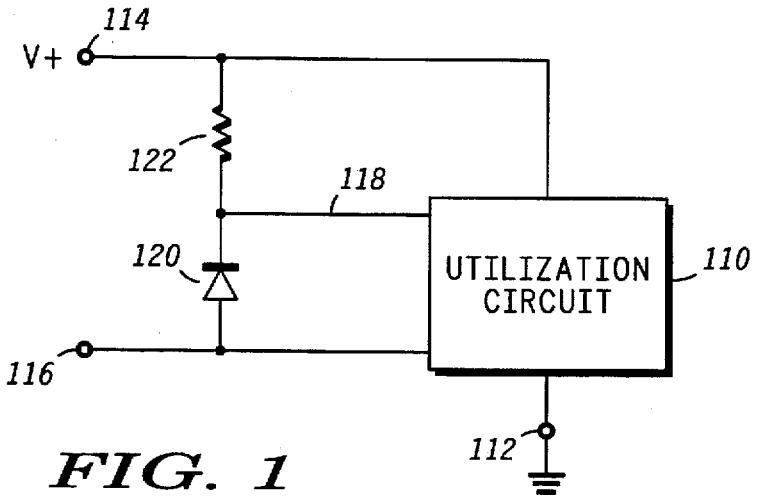
FIG. 1 is a block diagram of a prior art modification circuit.

It is known that for certain integrated circuit resistor configurations, passing predetermined current pulses through the resistor causes the resistance value to change to a new value. Shown in FIG. 1 is a prior art circuit for combining a resistor 122 of this type with a utilization circuit 110 in order to modify a parameter of the utilization circuit. Other elements included are a positive supply voltage conductor 114, an input terminal 116, a negative supply voltage terminal 112, and a diode 120 coupled between node 118 and input 116.

During normal operation current flows from positive supply voltage conductor 114 through resistor 122 to utilization circuit 110. The value of the current is adjusted by trimming resistor 122. The adjustment is accomplished with normal power off and voltage applied to cause current pulses from terminal 116 through diode 120 and resistor 122 to terminal 114. These current pulses are applied as required to change the value of resistor 122 until the current flowing, during normal operation, from terminal 114 through resistor 122 to utilization circuit 110 reaches the desired value.

The current pulses required to accomplish the change in resistance for resistor 122 are on the order of several hundred milliamps. In order to obtain this relatively large current flow the nominal resistance value of resistor 122 must be limited to a relatively small value on the order of 100 ohms. The required small value severely limits the applications for using resistor 122 during normal operation with utilization circuit 110.

In addition, as can be seen in FIG. 1, resistor 122 is subject to any unusual events, such as electrostatic discharge, which might appear on terminal 114 or 116. Also, in an integrated circuit, resistor 122 is normally a diffused resistor which has a fairly high temperature coefficient of resistance, e.g. 1000 ppm, and therefore subject to variation over temperature.

Figure 2:
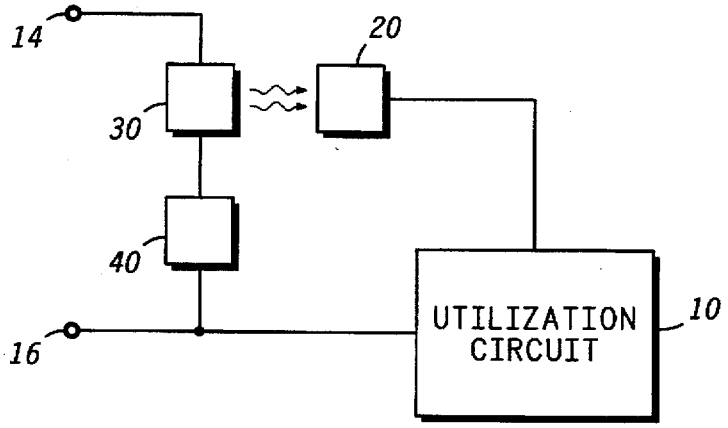
FIG. 2 is a block diagram of an embodiment of the present invention.

An embodiment of the present invention is shown in FIG. 2 wherein utilization circuit 10 receives an input signal from terminal 16. Circuit element 20 is an integral part of utilization circuit 10. Isolation circuit 40 is coupled between terminal 16 and modification circuit 30. During a trimming phase, modification circuit 30 thermally changes the value of circuit element 20 and thereby alters the electrical characteristics of utilization circuit 10. Once the value of element 20 is properly set, isolation circuit 40 electrically isolates modification circuit 30 from utilization circuit 10 during normal operation.

Figure 3:
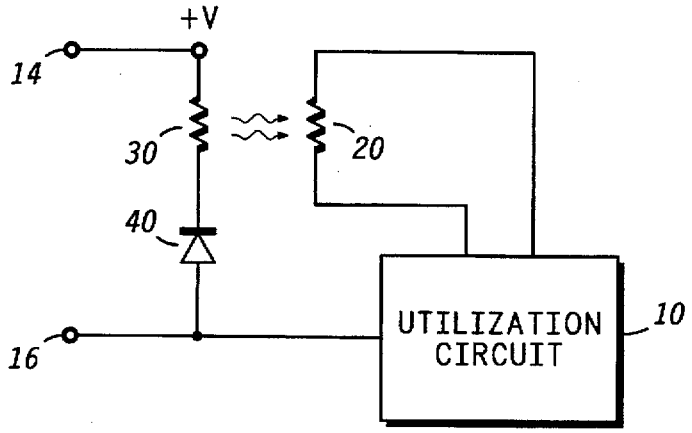
FIG. 3 is a schematic diagram of a specific embodiment of the present invention.

A more specific embodiment of the invention is depicted in FIG. 3 wherein element 20 is a thin film resistor which is part of utilization circuit 10, isolation circuit 40 is a diode, and modification circuit 30 is a heat emitting resistor which is coupled between the cathode of diode 40 and a positive supply voltage at terminal 14. Resistors 20 and 30 are constructed in an integrated circuit such that heat generated in resistor 30 is transferred to resistor 20 when a control current is passed through resistor 30. Thus, resistor 30 is thermally coupled to resistor 20 as shown by wavey lines; however, resistors 20 and 30 are electrically isolated as discussed below.

The modification of circuit element 20, in this case the trimming of resistor 20, is accomplished according to the following procedure. A pulsed control current is passed from terminal 16, through diode 40 and resistor 30 to terminal 14. The pulsed current flow results in a dissipation of power in the form of heat (i.e. thermal energy) in resistor 30 which is thermally transferred to resistor 20. Resistor 20 is comprised of a material which undergoes a change in resistance when subjected to a predetermined temperature which is substantially greater than its normal operating temperature. The amount of thermal energy radiated is determined by controlling the amplitude, pulse width and duty cycle of the control current pulses passing through resistor 30.

In an alternate embodiment, modification circuit 30 receives the control current pulses from a source other than the input of utilization circuit 10. The ultimate value of resistor 20 is determined in any number of ways including, but not limited to, observing certain operational characteristics of utilization circuit 10 during normal operation, and measuring the voltage developed across resistor 20 in response to a known current source.

During normal operation of utilization circuit 10, resistor 20 remains at its fixed value after the trimming procedure and passes a current based on inputs from other operational elements of utilization circuit 10. The normal input signals at terminal 16 are below the voltage level of supply voltage +V on terminal 14 and diode 40 is therefore reverse biased, preventing any current flow through resistor 30. Modification circuit 30 is thus isolated from utilization circuit 10. The trimmed value of resistor 20 changes the electrical characteristics of the utilization circuit. For example, resistor 20 may be part of an RC time constant for a timing circuit, or feedback resistance in an amplifier or filter application. Other examples include trimming the value of resistor 20 to obtain a certain offset voltage for an operational amplifier, or trimming resistor 20 to obtain a certain output voltage, where utilization circuit 10 is a solid state pressure sensor.

Figure 4:
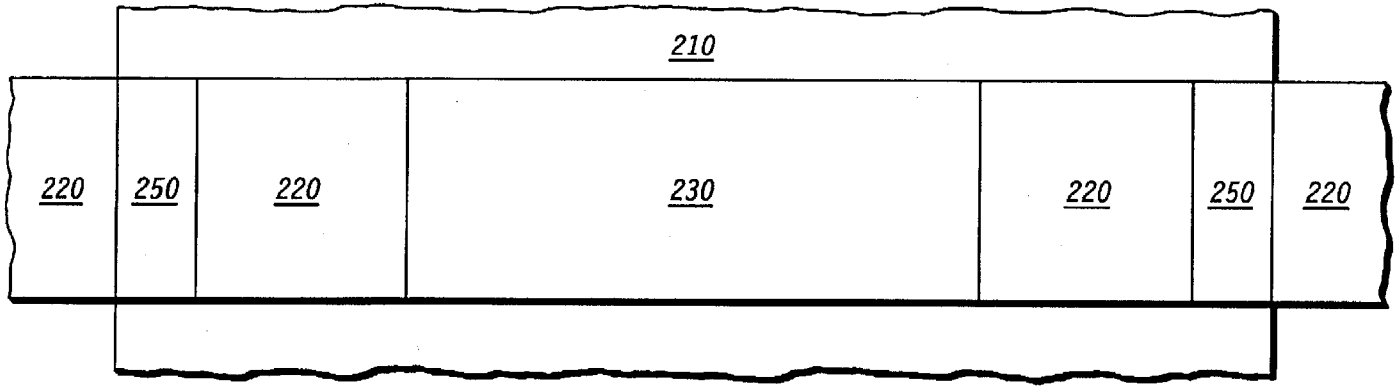
FIG. 4 is a partially cut away plan view of a portion of the modification circuit.
Figure 5:
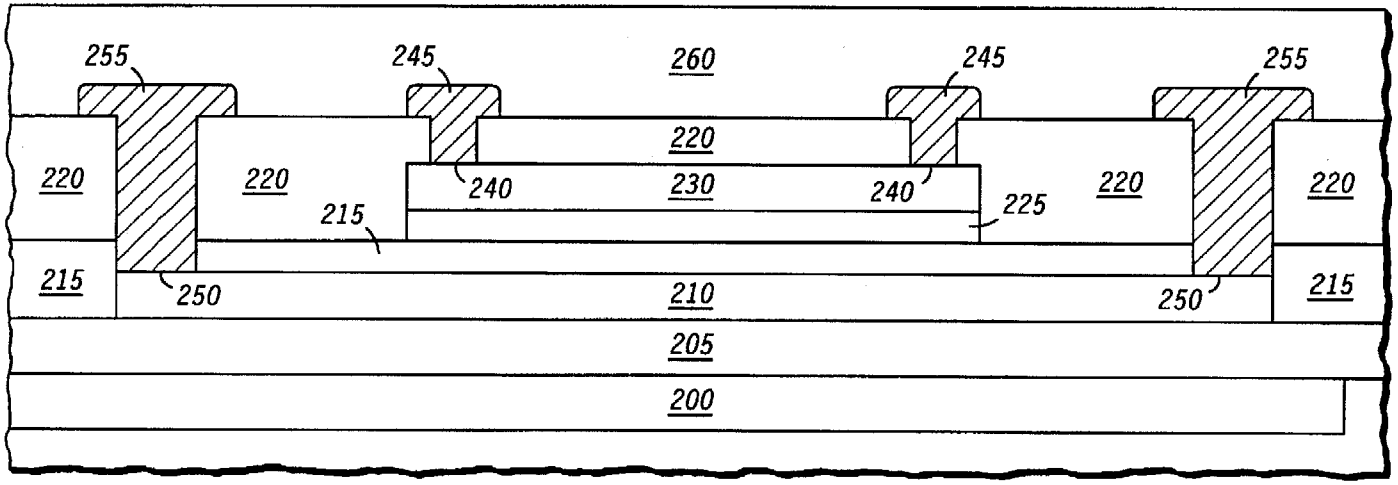
FIG. 5 is a cross sectional view of a portion of the modification circuit.

A more detailed description of the construction of resistors 20 and 30 is seen in FIGS. 4 and 5. A plan view of modification circuit 30 and element 20 is shown in FIG. 4 at the level of the top surface of resistor element 230. Heat emitting region 210 lies between contact regions 250. Trimmable resistor element 230 lies above heat emitting region 210. With reference to FIG. 3, heat emitting region 210 corresponds to resistor 30 and trimmable resistor element 230 corresponds to resistor 20. As discussed earlier, region 230 is depicted as a rectangular shape but may take any shape or thickness for the desired resistance value within the limiting factors of die space, photolithography and current density requirements. In addition, the entire region 230 need not overlie region 210 as long as there is sufficient thermal coupling to accomplish the desired resistance change.

FIG. 5 is a cross sectional view of FIG. 4 as shown. A substrate 200 with an initial oxide layer 205 having a thickness of 5 k–10 k Angstroms (Å) is formed. A polysilicon heat emitting resistive region 210, having a thickness of 3.5 k–5.0 k Å, is disposed above oxide layer 205 which was formed over substrate 200. The material, size, shape and geometric layout of region 210 can be varied as required for a particular application. A second oxide insulation layer 215, having a thickness of 2 k–3 k Å, is applied over heat emitting region 210 with appropriate openings masked for later application of contact regions 250.

A second undoped polysilicon barrier layer 225 having a thickness of 1 k–2 k Å is formed on top of insulation layer 215 to promote adhesion between insulation layer 215 and tungsten silicide layer 230, having a thickness of about 500 Å, which is applied to polysilicon layer 225. The tungsten silicide layer 230 and polysilicon layer 225 are masked and etched together to form the trimmable resistor.

A third oxide layer 220 is applied with appropriate openings for contact regions 240 and 250. Conducting regions 245 and 255 are added to provide for electrical connections to other circuit elements, such as utilization circuit 10 and diode 40 shown in FIG. 3. A passivation layer 260 is added over the entire integrated circuit.

As with heat emitting region 210, the material, size, shape and geometric layout of trimmable resistor element 230 is varied as required for a particular application. Using a tungsten silicide layer for resistor element 230, resistance values in the range of about 100 ohms to about 100K ohms are obtained.

A more detailed description of the resistance change as a result of heating is contained in U.S. Pat. No. 5,466,484, but essentially the material of region 230 undergoes a crystal structure change, commonly known as annealing, when heated to a predetermined temperature which is well above its normal operating range. An annealing element is a resistive or resistor element which is formed in close proximity to a second resistor element, for receiving electrical current pulses of predetermined parameters which generate sufficient thermal energy to cause a crystal structure change in the second resistor element, that either increases or decreases the resistive value of the second resistor element. The temperature at which the crystal structure change occurs is called the annealing temperature. Once a desired resistance value for region 230 is obtained through heating from annealing element 210, the resistance value of region 230 remains essentially unchanged during normal circuit operation.

The advantages and improvements of the present invention over the prior art are numerous and significant. As can be seen by reference to FIGS. 2 and 3, the modified circuit element of the utilization circuit is thermally coupled to and electrically isolated from the trimming circuit and therefore immune from various external electrical inputs such as an electrostatic discharge. Since the modified circuit element is no longer required to carry the large currents necessary for trimming, a much larger range of resistance values is obtained. Since the annealing element is located underneath the modified resistor, little additional die space is required. As with the prior art configuration, no additional external contact pins are required to perform the modification, or trimming, procedure. In addition, the present invention allows subsequent trimming operations at any time by providing sufficient current to the annealing element to heat the trimmed resistor above the previous annealing temperature, thereby causing additional crystal structure modifications and a resultant additional change in resistance.

While specific embodiments of the present invention have been shown and described, further modifications and improvements will occur to those skilled in the art. It is understood that the invention is not limited to the forms shown and it is intended that the appended claims cover all modifications which do not depart from the scope and spirit of the present invention.

What is claimed is:

1. A circuit for modifying operation of a utilization circuit, comprising:

a modification circuit that is thermally coupled to and electrically isolated from the utilization circuit and includes a conduction path that receives a control signal from a first terminal of the utilization circuit for modifying operation of the utilization circuit; and an isolation circuit coupled between the conduction path of the modification circuit and the first terminal of the utilization circuit such that operation of the utilization circuit is modified when the control signal at the first terminal of the utilization circuit is activated.

2. The circuit of claim 1 wherein the utilization circuit comprises a circuit element that is thermally coupled to and electrically isolated from said modification circuit where said circuit element controls a characteristic of the utilization circuit.

3. The circuit of claim 2 wherein said circuit element comprises a resistor.

4. The circuit of claim 3 wherein said resistor is a thin film resistor.

5. The circuit of claim 3 wherein said resistor comprises a material which undergoes a change in resistance when subjected to a predetermined temperature which is substantially greater than its normal operating temperature.

6. The circuit of claim 2 wherein said modification circuit comprises an annealing element.

7. The circuit of claim 6 wherein said annealing element is a heat emitting resistor that radiates thermal energy to said circuit element when enabled by said control signal.

8. The circuit of claim 1 wherein said isolation circuit includes a diode having a cathode coupled to said modification circuit and an anode coupled to said first terminal of the utilization circuit.

9. A method of modifying operation of a utilization circuit, comprising the steps of:

altering a characteristic of the utilization circuit with a modification circuit that is thermally coupled to and electrically isolated from the utilization circuit where the modification circuit has a conduction path that receives a control signal from a first terminal of the utilization circuit for altering the characteristic of the utilization circuit; and electrically isolating the conduction path of the modification circuit from the first terminal of the utilization circuit after the characteristic of the utilization circuit is altered.

10. The method of claim 9 further including the step of heating a circuit element in the utilization circuit in response to said control signal so as to change said characteristic of the utilization circuit.

11. The method of claim 10 wherein said circuit element is a resistor comprising a material that undergoes a change in resistance when subjected to a predetermined temperature which is substantially greater than its normal operating temperature.

12. The method of claim 11 further including the steps of:

providing a substrate layer;

forming a first oxide layer over said substrate layer;

forming a polysilicon heat emitting resistive region on said first oxide layer;

forming a second oxide layer over said polysilicon heat emitting resistive region;

forming a polysilicon barrier layer on said second oxide layer;

forming a silicide layer on said polysilicon barrier layer; and forming a third oxide layer on said silicide layer.

13. A trim circuit for modifying operation of a utilization circuit, comprising:

an annealing element that is thermally coupled to and electrically isolated from a circuit element in the utilization circuit and includes a conduction path that receives a control signal from a first terminal of the utilization circuit for modifying operation of the utilization circuit; and an isolation circuit coupled between the conduction path of the modification circuit and the first terminal of the utilization circuit such that operation of the utilization circuit is modified when the control signal at the first terminal of the utilization circuit is activated.

14. The trim circuit of claim 13 wherein said circuit element comprises a thin film resistor.

15. The trim circuit of claim 14 wherein said circuit element comprises a material which undergoes a change in resistance when subjected to a predetermined temperature which is substantially greater than its normal operating temperature.

16. The trim circuit of claim 13 wherein said annealing element is a heat emitting resistor that radiates thermal energy to said circuit element when enabled by said control signal.

17. The trim circuit of claim 13 wherein said isolation circuit includes a diode having a cathode coupled to said annealing element and an anode coupled to said first terminal of the utilization circuit.

18. The trim circuit of claim 13 wherein said control signal comprises current pulses of predetermined amplitude and duty cycle so as to cause a material in said circuit element to undergo a change in resistance when subjected to a predetermined temperature.

* * * * *